US005852250A

United States Patent [19]

Cha

[11] Patent Number: 5,852,250

[45] Date of Patent: Dec. 22, 1998

[54] PORTABLE INSTRUMENT STAND

[76] Inventor: Jennifer Cha, 1425 Blue Heron, Virginia Beach, Va. 23454

[21] Appl. No.: 857,493

[22] Filed: May 16, 1997

[51] Int. Cl.[6] ..... G10D 7/10

[52] U.S. Cl. ..... 84/327; 84/453

[58] Field of Search ..... 84/327, 453; 248/122.1

[56] References Cited

U.S. PATENT DOCUMENTS

| | | | |
|---|---|---|---|
| 1,060,581 | 5/1913 | Buegeleisen . | |
| 3,614,041 | 10/1971 | Koger . | |
| 3,638,888 | 2/1972 | Ross . | |
| 3,721,414 | 3/1973 | Yoder . | |
| 3,796,402 | 3/1974 | Trotta . | |
| 3,958,786 | 5/1976 | Mann . | |
| 4,157,801 | 6/1979 | Elmer . | |
| 4,708,307 | 11/1987 | Daigle . | |
| 4,712,756 | 12/1987 | Kester et al. . | |
| 4,742,751 | 5/1988 | Cherry . | |
| 4,759,518 | 7/1988 | Yardas . | |
| 4,856,740 | 8/1989 | MacLeod et al. . | |
| 4,874,141 | 10/1989 | Schulz . | |
| 4,946,118 | 8/1990 | Hastings . | |
| 5,018,691 | 5/1991 | King . | |
| 5,029,796 | 7/1991 | Schonig | 248/443 |
| 5,202,527 | 4/1993 | Gracie . | |
| 5,375,497 | 12/1994 | Pirchio et al. . | |
| 5,383,634 | 1/1995 | Liao . | |
| 5,488,890 | 2/1996 | Biasini | 84/280 |
| 5,505,413 | 4/1996 | Hennessey . | |
| 5,664,756 | 9/1997 | Liao | 248/443 |

*Primary Examiner*—William M. Shoop, Jr.
*Assistant Examiner*—Kim Lockett
*Attorney, Agent, or Firm*—Burns, Doane, Swecker & Mathis, L.L.P.

[57] ABSTRACT

A collapsible instrument stand for suspending an elongate instrument in a vertical orientation. The instrument stand generally includes three basic members: a base member which supports the stand, a head member from which an instrument is suspended, and a first member which rigidly supports the head member. The base and head members are preferably attached to respective ends of the first member in a pivotable manner. When configured for use, the base and head members are folded out to be generally orthogonal to the first member. When configured for storage and/or transportation, the base and head members are folded to become flush with, and generally be collateral and/or coplanar with the first member. In the latter configuration, the instrument stand can be stored within a flat outer compartment of an instrument case, if not within the instrument case itself.

19 Claims, 8 Drawing Sheets

PORTABLE INSTRUMENT STAND

BACKGROUND

The present invention relates to an instrument stand and more particularly, to a collapsible and portable instrument stand that is capable of supporting an instrument in a suspended fashion.

Portable instrument stands for supporting an elongate musical instrument by its base in a generally upright orientation are well known in the art. Where the instrument is a guitar, bass or the like, the stand supports the elongate instrument in an upright orientation with its longitudinal axis maintained generally vertically. A typical conventional stand comprises a multi-leg assembly including at least first and second vertically extending rigid legs disposed at a relative angle, with supports projecting outwardly from each of the legs for cooperatively supporting the base of the elongated instrument thereon. The multi-leg assembly may be tripod-like, in which case there is also a third vertically extending rigid leg. The tripod-like multi-leg assembly may be movable between a collapsed storage configuration, wherein all the legs extend generally parallel to one another, and a for-use configuration wherein all the legs are deployed at an angle to one another so as to provide a stable support for an instrument. Alternatively, the multi-leg assembly may include only the first and second legs disposed at a relative angle, with each of the legs having disposed at the free end thereof, opposite the junction of the legs, a stabilizing foot or base member extending transverse to a plane defined by both of the legs, thereby providing a stable base for the stand.

An example of a conventional collapsible musical instrument stand is set out in U.S. Pat. No. 3,958,786 to Mann. The instrument stand disclosed by Mann is a portable variety that supports a string instrument by its base while the instrument's neck rests on an extendable support. The stand is partially collapsible for storage and transport purposes. However, even when collapsed, the stand described by Mann generally remains bulky and cannot conveniently be transported in an instrument case.

A limitation of these prior art stands is that they support an instrument primarily by the instrument's base end, thereby potentially imparting undue mechanical stress. It will be further appreciated by those skilled in the art that horizontal instrument stands, such as those for supporting keyboards, are also unsuitable for supporting finer instruments. When a conventional horizontal stand is used to support a guitar, or other stringed instrument, the instrument's longitudinal axis may be sharply tilted laterally to one side or the other whereby the instrument rests in large part on its neck, thereby imparting undue stress.

Because conventional portable instrument stands support a stringed instrument primarily by its base and only secondarily by its neck in a leaning arrangement, such stands may not be entirely suitable for supporting more delicate stringed instruments, such as violins and violas. Such instruments are more properly supported in a suspended arrangement to avoid imparting undue stress on a base, or body portion, thereof. This may be done by hanging the stringed instrument from its neck in the case of a guitar (e.g., by use of dual hooks which clinch the flair at the base of the tuning peg board), or from its scroll in the case of a violin or viola. Indeed, in a fixed storage arrangement, such as an instrument cabinet, string instruments are typically supported by hanging. As those skilled in the art will appreciate, the latter is the recommended storage technique when a stringed instrument is not being transported. However, conventional portable instrument stands for elongate instruments do not provide for a suspended support arrangement, relying instead on primarily supporting a base/body portion wherein the neck rests on a vertical-type support in a leaning fashion.

Another problem with conventional portable instrument stands is that when designed to be collapsible into a storage and transport configuration, such a stand, even when collapsed, typically remains bulky. Consequently, the collapsed instrument stand cannot easily be stored within the confines of, or compartments of, an instrument case or satchel.

SUMMARY

These and other problems are alleviated in an instrument stand in accordance with the present invention.

An instrument stand in accordance with the present invention provides a number of features not found in conventional portable instrument stands. An instrument stand in accordance with the present invention can support an instrument in a suspended fashion thereby imparting a minimum amount of stress to the instrument. In addition, an instrument stand incorporating the invention can be collapsed into a storage/transportation configuration that is substantially planar, thereby rendering the stand in a flat, low-profile orientation. Consequently, the instrument stand, in a collapsed state, can be stored within a compartment of an instrument case, or within the instrument case's main compartment.

In accordance with an exemplary embodiment of the invention, the instrument stand includes a base member for supporting and stabilizing the instrument stand when it is in use (i.e., the base member is deployed). The base member is attached to a base end of a first member, which first member is maintained in a generally vertical orientation when the stand is in use. The end of the first member opposite the base end, or head end, has a head member attached to it. When deployed for use, the head member is maintained in a position, and provides a means, whereby an instrument can be supported in a suspended manner. In a preferred embodiment, both the base and head members are pivotably connected to the first member with rotatable connectors. Detente mechanisms within the rotatable connectors secure the base and head members in a substantially orthogonal orientation relative to the first member when in a for-use configuration. In a collapsed configuration, the detente mechanisms retain the base and head members in a flush orientation so that the base, head, and first members are all substantially collateral and/or coplanar.

More particularly, a preferred exemplary arrangement involves an instrument stand that includes a first member having a base end and a head end. A base member is pivotably connected to the base end of the first member and maintains the first member in a substantially fixed, generally vertical orientation when the base member is in a deployed position. When collapsed for storage and/or transportation, the base member fold so as to be substantially planar with the first member. A head member is pivotably connected to the head end of the first member and is maintained in a substantially fixed orthogonal orientation relative to the first member when the head member is in a deployed position. When collapsed for storage and/or transportation, the head member folds up so as to be substantially planar with the first member and collapsed base member. A mechanism for hanging an instrument, such as a hook, or a strap spanning the head member can be provided, which hanging mechanism is capable of receiving an instrument so as to support the instrument in a suspended fashion. Alternatively, the head member can be specially configured to receive, and thereby suspend, a particular type of instrument.

BRIEF DESCRIPTION OF THE DRAWINGS

The foregoing, and other objects, features and advantages of the present invention will be more readily understood upon reading the following detailed description in conjunction with the drawings in which.

DETAILED DESCRIPTION

Figure 1A:
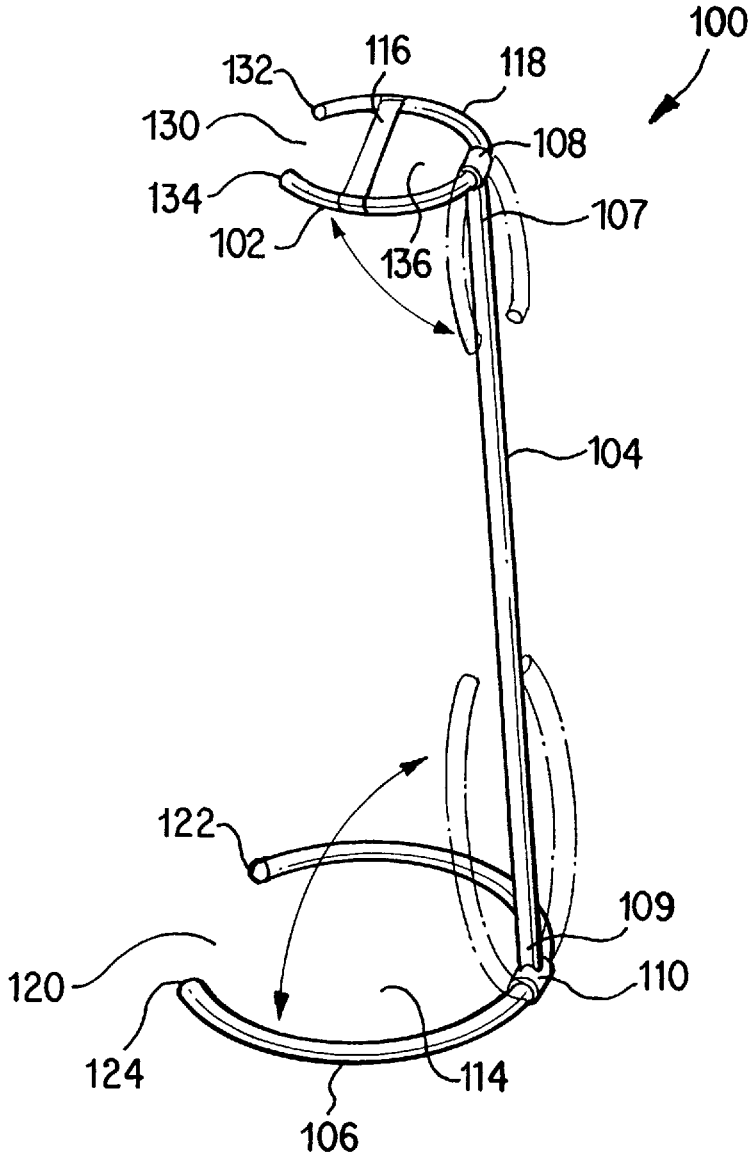
FIG. 1A depicts an exemplary instrument stand in accordance with the invention.

An exemplary instrument stand in accordance with the invention is depicted in FIG. 1A. The instrument stand 100 includes a base member 106 (shown in a deployed configuration) which is pivotably connected to a base end 109 of a first member 104 by a connector 110. When deployed for use, the base member 106 stably supports and thereby rigidly maintains the first member 104 in a generally upright position. A head end 107 of the first member 106 has a head member 102 (shown in a deployed configuration) pivotably connected thereto by a connector 108. In the exemplary embodiment shown, the head member 102 includes a strap 116 for suspending an instrument (not shown), such as a violin. The strap 102 may include a hook 118 for additionally hanging a bow (not shown).

A base member in a stand in accordance with an exemplary embodiment may include a multi-leg assembly including at least first and second extending rigid legs disposed at a relative angle from the first member 104, with a common couple connecting the legs and for supporting the first member 104. The multi-leg assembly may be tripod-like, in which case there can also be a third extending rigid leg. The tripod-like multi-leg assembly may be movable between a collapsed storage configuration, wherein the legs reside generally parallel to one another, and a for-use configuration wherein the legs are deployed so as to provide a stable support for the first member 104. Alternatively, the multi-leg assembly may include only first and second legs disposed at a relative angle, with each of the legs having disposed at the free end thereof, opposite the junction of the legs, a stabilizing foot or base member, thereby providing a stable base.

Figure 1B:
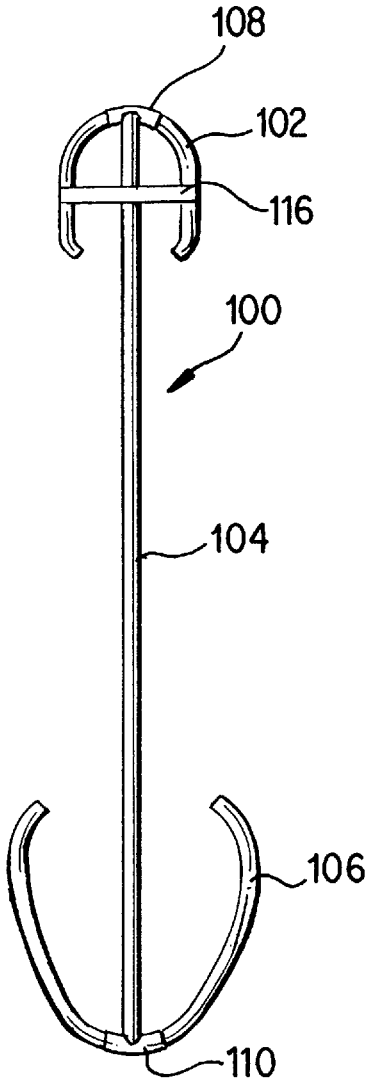
FIGS. 1B and 1C depict top and side views of the exemplary instrument stand of FIG. 1A when the instrument stand is in a collapsed configuration.
Figure 1C:
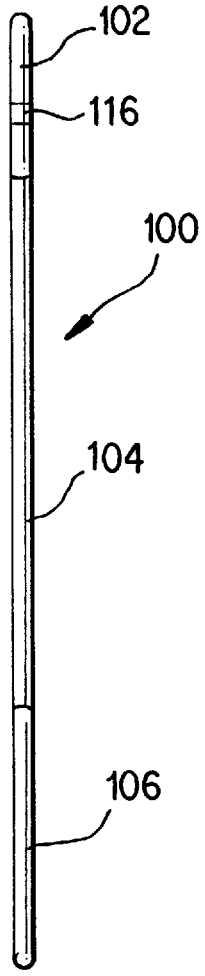

In a preferred embodiment, the base member 106 defines a sufficiently large swept area to provide stability to the instrument stand 100 when the stand is configured for use. The base member 106 can be configured to define any of a variety of hollow shapes having perimeters defining, for example, an oval, circle, "U" shape, "V" shape, or square. Preferably, a portion of the base member 106 opposite the connector 110 defines a gap 120, between end points 122 and 124 of the base member limbs. The purpose of the gap 120 is to permit the base member 106 to be folded into a storage, or transportation configuration, wherein the base member 106 is substantially flush, collateral with, or resides in a same plane as, the first member 104. When in a collapsed configuration, the first member 104 is received within the hollowed area 114 defined by the limbs of the base member 106, and also is received by the gap 120. The position of the base member 106 in a collapsed position is shown in phantom in FIG. 1A. FIG. 1B depicts a top view of the exemplary instrument stand 100 of FIG. 1A when the instrument stand 100 is in a collapsed configuration. FIG. 1C depicts a side view of the exemplary instrument 100 stand of FIG. 1A when the instrument stand 100 is in a collapsed configuration, and illustrates that the head member 102, base member 106 and first member 104 of an exemplary instrument stand 100 all reside substantially within a common plane in such a configuration.

The first member 104 is selected to have sufficient length to suspend the head member 102 above the base member 106 such that an instrument suspended from the strap 116 (or head member 102) can hang freely. In the case of a violin or viola, the length of the first member 104 may be dictated by the length of the violin or viola bow, rather than by the length of the violin or viola, itself. For aesthetic purposes, the shape of the first member 104 can be selected in accordance with personal tastes. For example, the first member 104 can be fashioned to resemble the curvature of the "f-hole" found in the body of a violin or viola.

In an exemplary embodiment, the head member 102 is devised to securely receive and suspend an instrument when the instrument stand 100 is configured for use. The head member 102 can be configured to define a variety of hollowed shapes such as a an oval, "U" or "V" shape. The hollowed portion of the head member 102 can include a means for hanging an instrument, such as the strap 116, which can receive a scroll of a violin by which the violin is suspended.

In a preferred embodiment, a portion of the head member 102 opposite the connector 108 defines a gap 130, between head member end points 132 and 134 of the head member limbs. The purpose of the gap 130 is to permit the head member 102 to be folded into a storage, or transportation configuration, wherein the head member 102 is substantially flush with, or resides generally in a same plane as, the first member 104 and the collapsed base member 106, shown in phantom. When in a collapsed configuration, the first member 104 is received within the hollowed area 136 defined by the limbs of the head member 102, and also is received by the gap 130. A collapsed head member, shown in phantom, depicts the head member 102 in a collapsed position. The gap 130 also acts to facilitate hanging of an instrument on the strap 116, as the neck of the instrument can pass through the gap 130.

Figure 4:
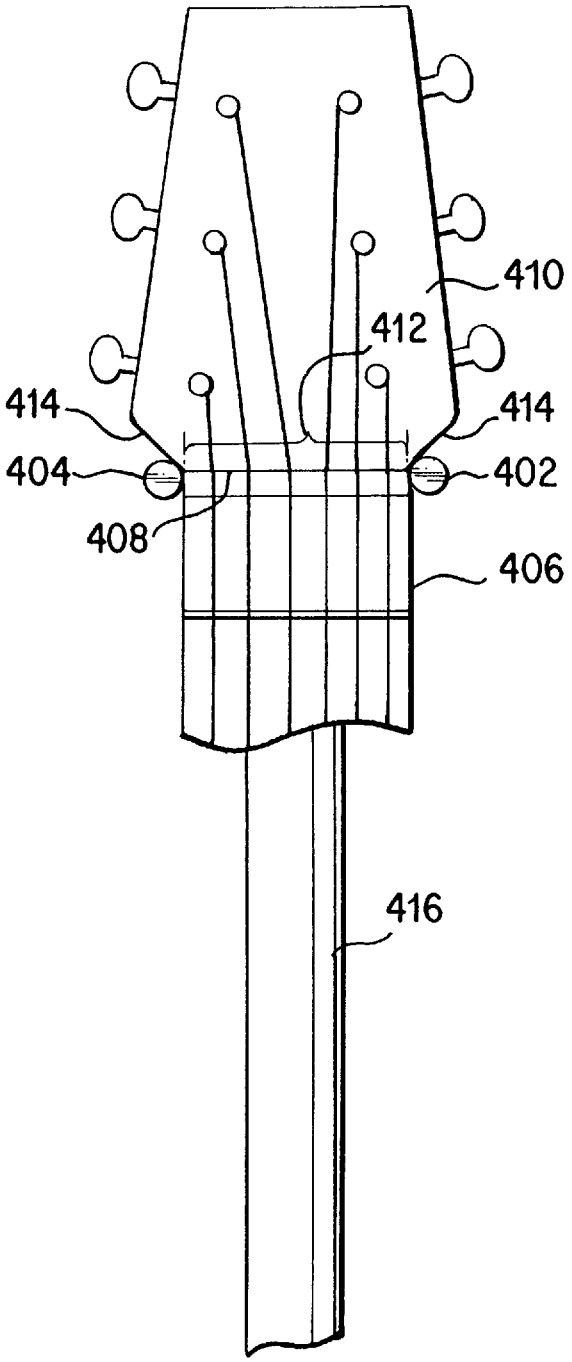
FIG. 4 depicts an exemplary head member configuration that conforms to the particular characteristics of an instrument.

Alternatively, the head member 102 can be selected or configured to uniquely receive, and thereby secure, a particular type of instrument. For example, as depicted in FIG. 4 a pair of spaced prongs 402 and 404 can be used that are positioned to receive the neck 406 of a guitar at an area 408 where the neck 406 connects to a portion of guitar's tuning-peg board 410. The guitar is suspended by the flared shoulders 414 at the base of the tuning peg board 410. The gap 412 between the spaced prongs 402 and 404 can receive a first member 416 when the head member is in a collapsed position.

Figure 5A:
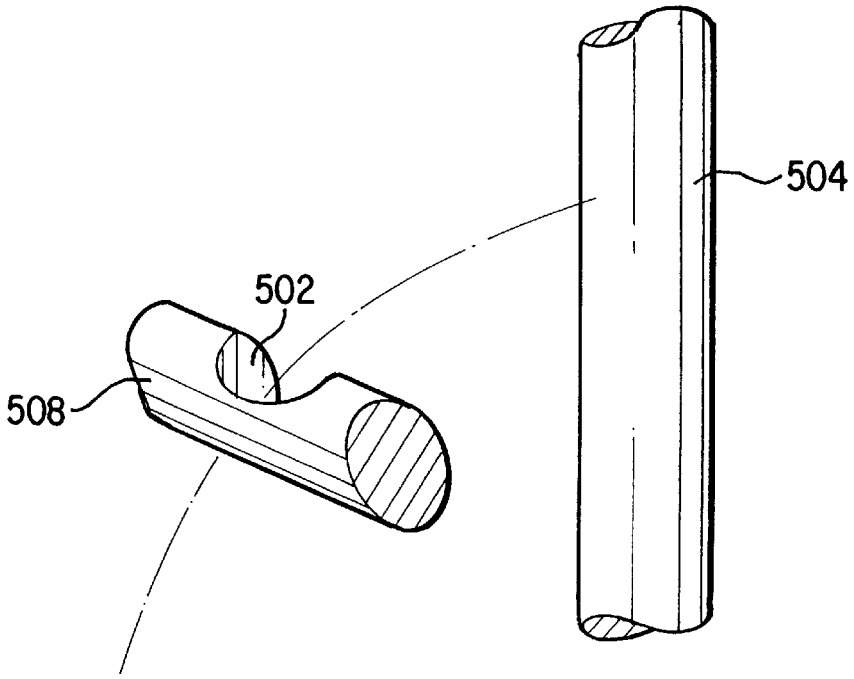
FIGS. 5A and 5B depict exemplary configurations of instrument stand members at points where they contact one another when the stand is in a collapsed position.
Figure 5B:
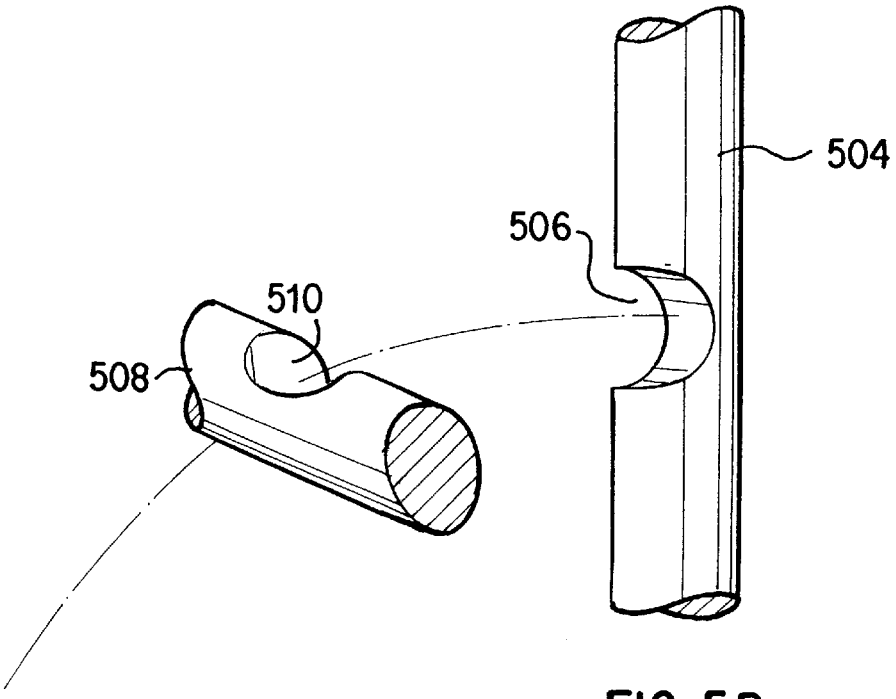

In another embodiment of the invention, the base or and/or head member can define a hollow enclosure that has no gap. In such a case, it is preferable to have a groove, or inclusion at a point on the base or head member where the base or head member contacts the first member. As depicted in FIG. 5A, a groove or inclusion 502 is formed in the base or head member 508 that conforms to the cross-sectional profile of the first member 504 thereby permitting the base or head member 508 to fold flush with the first member 104 when the instrument stand is collapsed into a storage/transport configuration. Alternatively, a groove can be formed in the first member 504 to receive a cross-sectional profile of a base or head member at the point of contact, or, as shown in FIG. 5B both the base/head member 508 and the first member 504 can have matched inter-meshing grooves 510 and 506, respectively.

Figure 2:
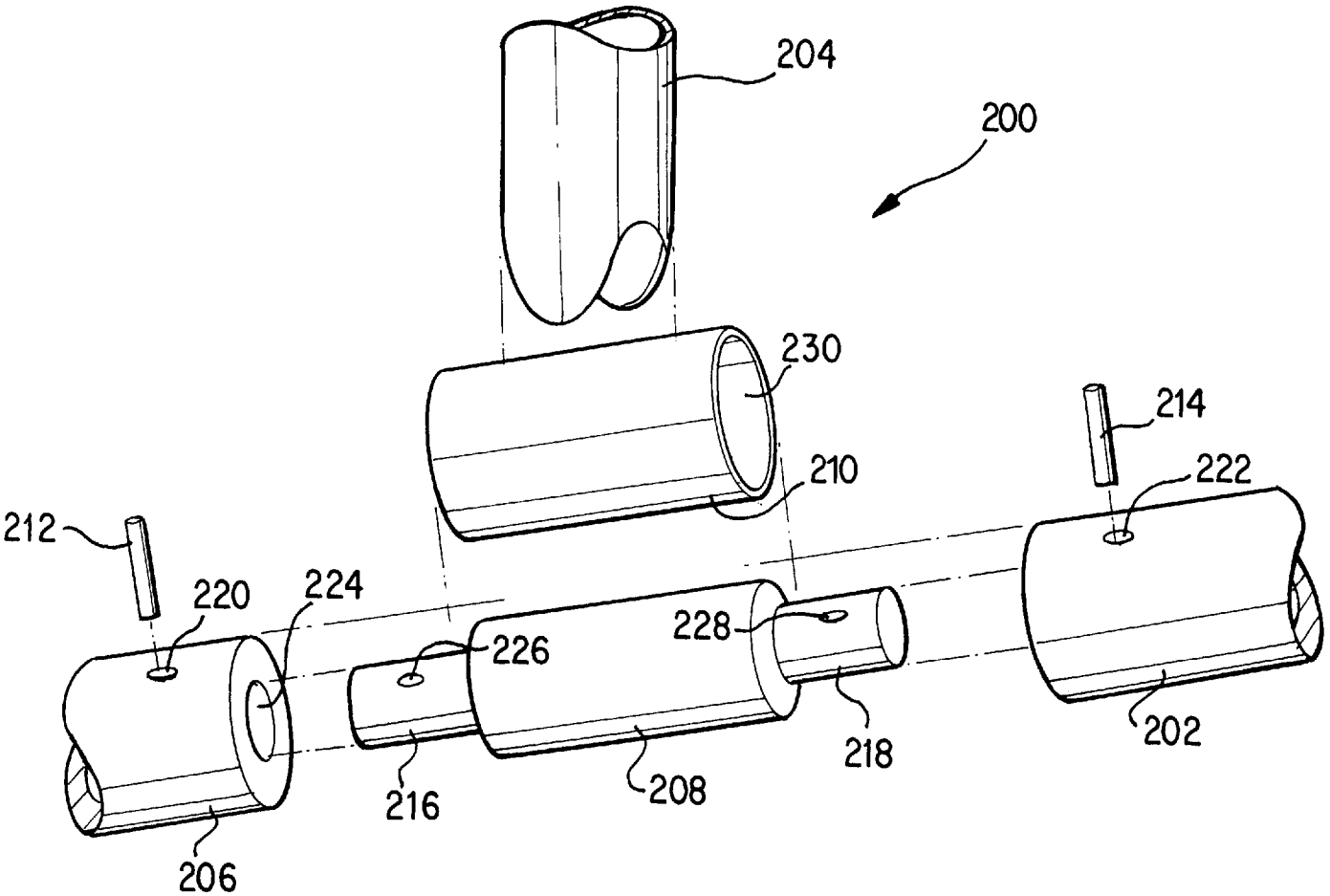
FIG. 2 depicts the components of a rotatable connector in an exemplary embodiment of the invention.

Referring again to FIG. 1A, the base member 106 and head member 102 are connected to the first member 104 by connectors 110 and 108, respectively. FIG. 2 depicts a disassembled exemplary connector arrangement 200 involving a friction hinge. An end portion of a first member 204 is connected to a tubular outer sleeve 210 by gluing, welding, brazing, or like fusing. A connecting shaft 208 is ensconced within the outer sleeve 210 and rotatable therewithin. Shaft ends 216 and 218 receive end portions 206 and 202 of tubing from which the limbs of the base and/or head members are formed. An inner tube portion 224 of end portion 206 is fit over the shaft end 216 and fixed thereto by a press-fit pin 212 that is inserted through a tubing hole 220, which press-fit pin 212 is secured within a shaft hole 226. End portion 202 is similarly fixed to the shaft end 218 by inserting a press-fit pin 214 through tubing hole 222 and securing the press-fit pin 214 within shaft hole 228.

In an arrangement incorporating the hinge of FIG. 2, the base and/or head member is fixed in a selected position by virtue of friction between an outer surface of the connecting shaft 208 and an inner surface 230 of the tubular outer sleeve 210. However, alternative exemplary embodiments can incorporate other hinging mechanisms that include detente mechanisms for fixing the head and base members in a deployed position for use, or in a collapsed position for storage and transportation. Such a detente mechanism can involve a connector whereby a base or head member is fixed in a for-use configuration in a substantially orthogonal position relative to the first member. When not deployed for use, a head or base member can rotate marginally under inherent friction within the connection mechanism. However, when completely deployed into a for-use position, the base/head member (or the first member), is rotated to render it and the first member in substantially orthogonal positions relative to one another.

In an exemplary embodiment, at the rotation point where the base or head member achieves a desirable deployed position, a ratchet engages a catch within the connector thereby securing the member in a from returning to a storage position. To disengage the ratchet mechanism, the member can be rotated beyond the in-use position whereby the ratchet is released, allowing the member to rotate marginally toward the storage position. Such a mechanism is not unlike that found in foldable beach chairs whose back rests can be incrementally ratcheted toward a more and more upright position until the backrest is beyond a vertical point. At such a point, the ratchet mechanism is released thereby allowing the backrest to recline fully.

Figure 6:
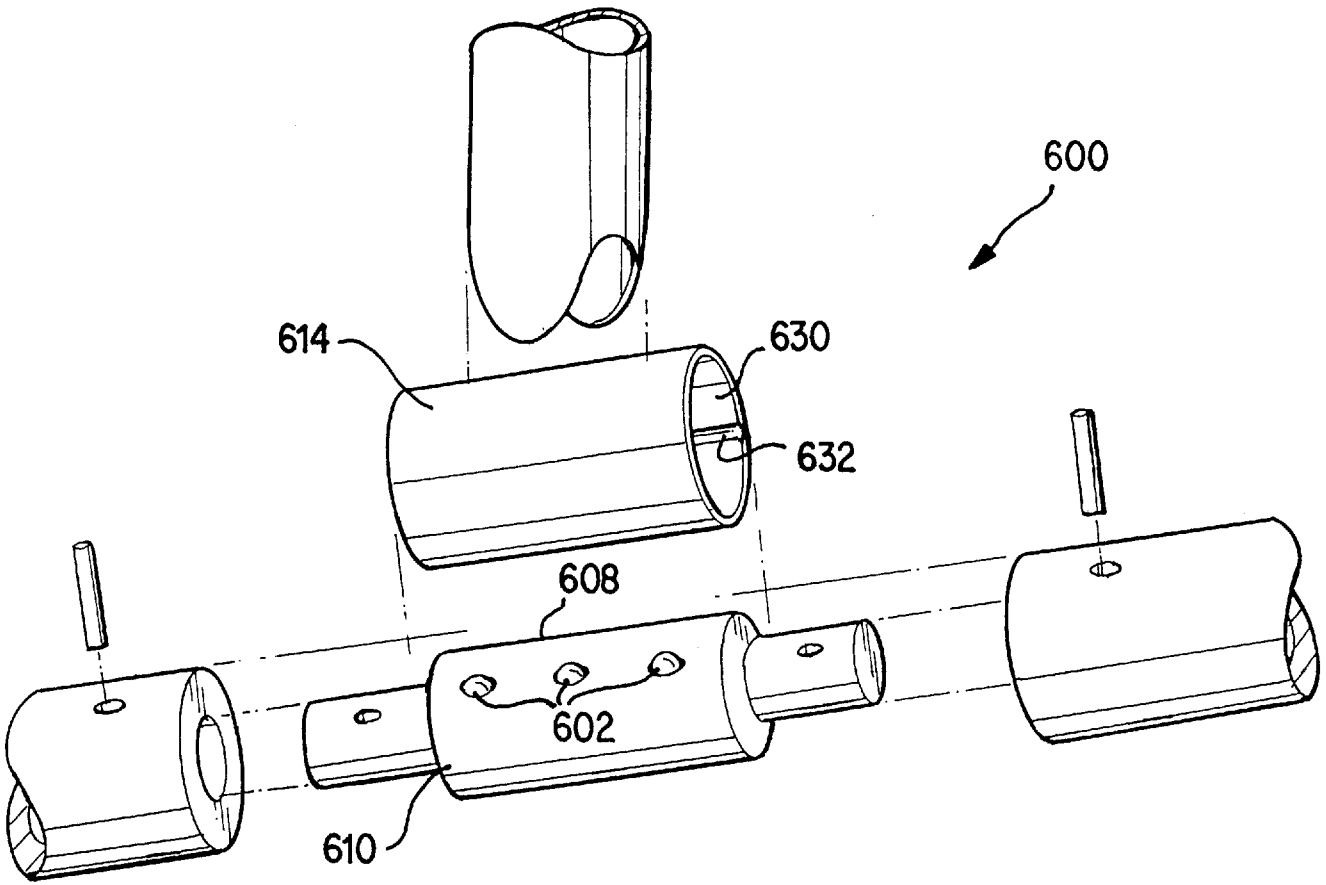
FIG. 6 depicts an exemplary rotatable connector having a detente mechanism.

Another possible connection detente mechanism in an instrument stand in accordance with an exemplary embodiment of the invention, can involve one or more spring-loaded ball bearings that are received by an inclusion or groove at an appropriate detente position. As applied in a connector 600 of FIG. 6, spring loaded ball-bearings 602 can partially protrude from a surface 610 of the connecting shaft 608. A groove 632 formed on an inner surface 630 of a tubular outer sleeve can positioned to receive the spring-loaded ball bearings 602. The position of the groove 632 in the outer sleeve can be selected so as to detain a member in either a storage/transport or for-use position. A second groove can be formed so that a member can be detained in both storage and deployed positions. Rotation of a member can be further restricted by forming the connection so that a member can rotate only over a restricted 90° range, for example. At each extreme of the range, the member can be detained by a spring-loaded ball bearing, friction, ratchet, or other suitable mechanism to substantially fix the member in position.

Yet another possible detente mechanism for maintaining the base and/or head member in position is an insertable pin that can prevent member rotation when the pin is inserted in place. For instance, a hole formed within a the connector portion of a head member is positioned so as to be aligned with a corresponding hole within the connector portion of the first member when the head member is in a desired deployment position. Once aligned, the user inserts the pin to fix the head and first members relative to one another and thereby prevent further rotation. The pin can be tethered to the instrument stand in the region of the connector so as to prevent its loss when not in use. Furthermore, a storage position hole can also be formed in the connector portion of the first member that corresponds to fixing the base or head member in a collapsed position. When the pin is inserted the member is prevented from further rotation.

Figure 7:
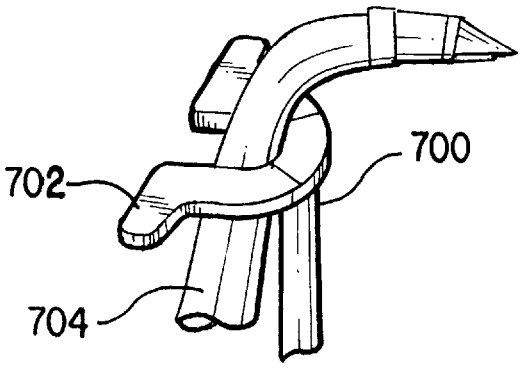
FIG. 7 depicts an exemplary head member that is particularly configured to receive a specific type of instrument.

In accordance with an instrument stand incorporating the invention, an instrument is supported by the head member in a suspended fashion. This can be achieved in a variety of ways. As depicted in FIG. 1, a strap 116 spans the arms of the head member. The strap can, for example, receive and support the scroll of a violin. The violin bow can be hung from a hook 118. In accordance with alternative embodiments, the head member can be shaped to conform to, and thereby support, an instrument in accordance with the instrument's particular physical attributes. For example, a head member can be formed to conform to the cross sectional width of a saxophone tube piece located proximal to the mouth piece of the saxophone. As depicted, for example, in FIG. 7, such a head member 702 may be a U-shaped piece having a rubber, or other soft-grip coating, that clinches the saxophone tube 704 when the saxophone is suspended by the head member 702 of the instrument stand 700.

Figure 3:
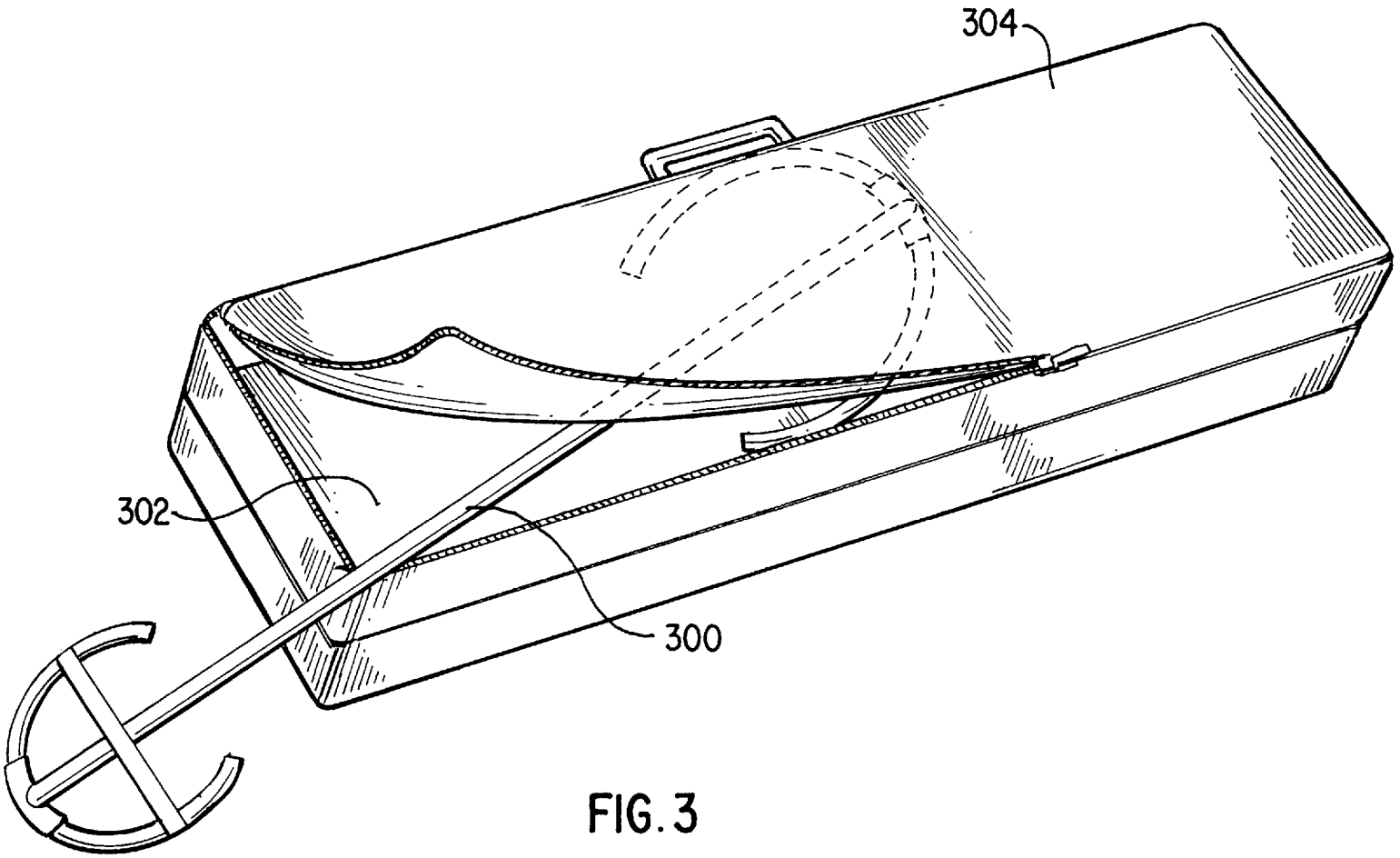
FIG. 3 depicts an exemplary instrument stand in accordance with the invention in a storage/transport configuration.

Another aspect of an instrument stand in accordance with the invention is the instrument stand's ability to be collapsed, or folded, into a substantially flat, or planar, configuration for storage and/or transportation wherein the base, first and head members are generally collateral and coplanar to one another. This capability offers the advantage that the instrument stand can be stored within an instrument case, or in an outer compartment, such as a music pocket, of the instrument case. Conventional instrument stands also collapse into a storage and transportation configuration, however, such configurations typically remain bulky and unfit for storage within an instrument case or a compartment thereof. As depicted, for example, in FIG. 3, a violin stand

300 in accordance with the invention can be stored in a music pocket 302 of a violin case 304.

In accordance with another feature of the invention, the first member can be telescopic. This permits the instrument stand to be further collapsed to reduce its collapsed length. The telescopic sections can be fixed in a for-use position by use of friction clinching between distal ends of consecutive tube sections, twist clinching of the same, mating circumferential grooves and dimples at respective tube ends, or any other like fixing means that maintain the first member in a rigid state when the instrument stand is in use.

An instrument stand in accordance with the invention can be fabricated from any of a variety of suitable materials. It is generally preferable that the stand be made of light weight materials in view of its portability. Suitable materials may include lightweight metal tubing, such as aluminum. Plastic, fiberglass or like materials may also be used. The thickness of the tubing is selected in view of strength and rigidity requirements of the instrument stand. Tubing used for the base member may be solid, or be filled with sand, or like material, to add stability to the stand when in use.

Because an instrument can be suspended in a manner that may permit it to swing about its support point, it may be desirable to fabricate the first member from a material that is less prone to dent or mark the instrument in the event of contact therebetween. In the case where the first member is made of a hard material, such as metal, it may be desirable to locate padding over the entire first member, or position padding at one or more likely contact points for protection of the instrument in the event of contact between the instrument and the first member.

It will be appreciated by those skilled in the art that the orientation of the first member can be slightly tilted when the instrument stand is in a for-use configuration. Accordingly, a head member, when fixed in a for-use configuration need not be exactly orthogonal, relative to the first member, because of the first member's tilted orientation. Nevertheless, the arrangement permits an instrument suspended from the stand to hang freely without additional contact with the first member, which contact may be possible with awkwardly weighted instruments such as saxophones.

The invention has been described with reference to particular embodiments. However, it will be readily apparent to those skilled in the art that it is possible to embody the invention in specific forms other than those of the embodiments described above. Embodiment of the invention in ways not specifically described may be done without departing from the spirit of the invention. Therefore, the preferred embodiments described herein are merely illustrative and should not be considered restrictive in any way. The scope of the invention is given by the appended claims, rather than by the preceding description, and all variations and equivalents which fall within the range of the claims are intended to be embraced therein.

What is claimed is:

1. An instrument stand for a stringed musical instrument comprising:

a first member having a base end and a head end;

a base member connected to the base end of the first member and moveable from a base member deployed position to a base member collapsed position, the base member forming an acute angle with respect to the first member when the base member is in said base member deployed position and the base member residing generally within a same plane as the first member when the base member is in said base member collapsed position; and a head member connected to the head end of the first member and moveable from a head member deployed position to a head member collapsed position, the head member generally residing within the same plane as the first member when the head member is in said head member collapsed position, said head member and said base member being located on a same side of a plane containing said first member when said base member is in said base member deployed position and when said head member is in said head member deployed position; and the head member including means for supporting the stringed musical instrument in a suspended manner when said base member is in said base member deployed position and when said head member is in said head member deployed position.

2. The instrument stand of claim 1, wherein at least one of the base member and head member is connected to the first member by a rotatable connector.

3. The instrument stand of claim 2, wherein the base member defines a hollow shape, which hollow shape has a gap formed at a point opposite of the rotatable connector such that the first member is received in the gap when the base member is configured in the base member collapsed position.

4. The instrument stand of claim 2, wherein the base member defines a hollow shape, which hollow shape has an inclusion formed at a point opposite of the rotatable connector such that the first member is received in the inclusion when the base member is configured in the base member collapsed position.

5. The instrument stand of claim 2, wherein the head member defines a hollow shape, which hollow shape has a gap formed at a point opposite of the rotatable connector such that the first member is received in the gap when the head member is configured in the head member collapsed position.

6. The instrument stand of claim 2, wherein the head member defines a hollow shape, which hollow shape has an inclusion formed at a point opposite of the rotatable connector such that the first member is received in the inclusion when the head member is configured in the head member collapsed position.

7. The instrument stand of claim 2, wherein the rotatable connector includes a detente mechanism.

8. The instrument stand of claim 7, wherein the detente mechanism includes a ratchet.

9. The instrument stand of claim 7, wherein the detente mechanism includes an insertable pin.

10. The instrument stand of claim 7, wherein the rotatable connector includes an inner shaft that rotates within an outer sleeve.

11. The instrument stand of claim 10, wherein the detente mechanism involves friction between the inner shaft and outer sleeve.

12. The instrument stand of claim 10, wherein the detente mechanism includes at least one spring-loaded ball bearing that partially protrudes from an outer surface of the inner shaft, the at least one ball bearing being received in an inclusion defined in an inner surface of the outer sleeve.

13. The instrument stand of claim 2, wherein the rotatable connector is capable of rotating only over a defined range.

14. The instrument stand of claim 7, wherein the rotatable connector is capable of rotating only over a defined range.

15. The instrument stand of claim 1, wherein at least one of the base member, the head member, and the first member is made from tubing.

16. The instrument stand of claim 1, wherein the head member is configured to receive and suspend an instrument in accordance with the particular physical characteristics of the instrument.

17. The instrument stand of claim 1, wherein the base member defines a multi-leg assembly.

18. The instrument stand of claim 1, wherein the first member includes padding for protection of an instrument in the event of contact between the instrument and the first member.

19. An instrument stand for a stringed musical instrument comprising:

a first member having a base end and a head end;

a base member connected to the base end of the first member and being movable between a deployed position and a collapsed position, the base member maintaining the first member in a generally fixed vertical orientation when the base member is in the deployed position, the base member residing within a same plane as the first member when the base member is in the collapsed position;

a head member pivotably connected to the head end of the first member and being movable between a deployed position and a collapsed position, the head member being maintained in a generally fixed orthogonal orientation relative to the first member when the head member is in the deployed position, the head member residing within the same plane as the first member when the head member is in the collapsed position;

the head member including means for supporting an instrument in a suspended manner; and wherein the head member and the base member are located on a same side of a plane containing the first member when the base member and the head member are located in the deployed positions.

* * * * *